US008923730B2

(12) United States Patent
Hashimoto et al.

(10) Patent No.: US 8,923,730 B2
(45) Date of Patent: Dec. 30, 2014

(54) IMAGE FORMING APPARATUS

(71) Applicants: Haruo Hashimoto, Osaka (JP); Tatsuo Fukushima, Osaka (JP); Masafumi Takahira, Osaka (JP)

(72) Inventors: Haruo Hashimoto, Osaka (JP); Tatsuo Fukushima, Osaka (JP); Masafumi Takahira, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/852,140

(22) Filed: Mar. 28, 2013

(65) Prior Publication Data

US 2013/0266340 A1 Oct. 10, 2013

(30) Foreign Application Priority Data

Apr. 10, 2012 (JP) ..... 2012-089501
Dec. 19, 2012 (JP) ..... 2012-276900

(51) Int. Cl.
*G03G 15/04* (2006.01)
*G03G 21/16* (2006.01)

(52) U.S. Cl.
CPC ..... *G03G 21/1676* (2013.01)
USPC ..... 399/119; 399/110; 399/113; 399/114

(58) Field of Classification Search
USPC ..... 399/110, 111, 113, 114, 119, 380, 411
See application file for complete search history.

(56) References Cited

U.S. PATENT DOCUMENTS

| | | | | |
|---|---|---|---|---|
| 6,115,571 | A * | 9/2000 | Kobayashi | 399/119 |
| 7,925,182 | B2 * | 4/2011 | Ishiguro et al. | 399/113 |
| 2010/0067942 | A1 | 3/2010 | Hagiwara et al. | |
| 2011/0058847 | A1 | 3/2011 | Furuichi et al. | |
| 2011/0064456 | A1 | 3/2011 | Tada et al. | |
| 2012/0114373 | A1 * | 5/2012 | Hamada et al. | 399/110 |
| 2013/0164033 | A1 * | 6/2013 | Okabe | 399/119 |
| 2013/0259532 | A1 * | 10/2013 | Kubota et al. | 399/254 |

FOREIGN PATENT DOCUMENTS

JP 2001-222160 8/2001

* cited by examiner

*Primary Examiner* — Francis Gray
(74) *Attorney, Agent, or Firm* — Oblon, Spivak, McClelland, Maier & Neustadt, L.L.P.

(57) ABSTRACT

An image forming apparatus includes: a developer container to contain a developer therein and a developer supply port; an image forming unit to form an image with the developer from the developer container and including a developer intake port; an openable/closable upper cover configured to cover an upper part of the developer container in a closed state and take out the developer container in an open state; an openable/closable retention cover to hold the developer container and configured to allow the image forming unit to be removed when the retention cover is opened; a coupling device to secure a coupled state of the developer supply port of the developer container with the developer intake port of the image forming unit when the upper cover is in a closed state; and a disconnection preventer to prevent the developer container from disconnecting from the retention cover when the upper cover is opened.

18 Claims, 9 Drawing Sheets

IMAGE FORMING APPARATUS

CROSS-REFERENCE TO RELATED APPLICATIONS

The present application claims priority pursuant to 35 U.S.C. §119 from Japanese patent application numbers 2012-089501 and 2012-276900, filed on Apr. 10, 2012 and Dec. 19, 2012, respectively, the entire disclosures of which are incorporated by reference herein.

BACKGROUND

1. Technical Field

The present invention relates to an image forming apparatus employing an electrophotographic method, such as a copier, a printer, a facsimile machine, and a multifunction apparatus having one or more capabilities of the above devices.

2. Related Art

In an image forming apparatus employing an electrophotographic method, such as a copier, a printer, a facsimile machine, and a multifunction apparatus having one or more capabilities of the above devices, an electrostatic latent image formed on a photoreceptor or a photoreceptor drum as an image carrier is supplied with toner by a developing means to render the latent image visible and the thus-formed visible image is transferred to a recording medium, for example, a sheet of paper.

A processor part of the image forming apparatus is divided into two parts due to a difference in lifetime: one is a process cartridge including a developing means and used as a developer receiving cartridge; and another is a toner cartridge to supply toner as a developer replenishing cartridge. The toner cartridge includes a toner outlet serving as an opening through which the developer is discharged. The process cartridge includes a toner intake port serving as an opening through which the developer is taken in. The toner outlet and the toner intake port are communicated with each other so that the process cartridge is replenished with toner.

Thus, because the parts with a different lifetime are separately formed, consumable parts may be replaced effectively. However, because the process cartridge and the toner cartridge are separately formed and therefore are positioned separately, a problem of scattering of toner occurs.

To cope with this problem, JP-2001-222160-A discloses a technique in which a shutter mechanism is disposed between the process cartridge and the toner cartridge. The process cartridge includes a toner intake port shutter disposed at the toner intake port and the toner cartridge includes a toner outlet shutter disposed at the toner outlet. The toner intake port shutter of the process cartridge opens the intake port when the process cartridge is mounted to the image forming apparatus and closes the intake port when the process cartridge is removed from the image forming apparatus. As to the toner outlet shutter disposed at the toner outlet of the toner cartridge, the toner outlet shutter opens the outlet when the toner cartridge is mounted to the image forming apparatus and closes the outlet when the toner cartridge is removed from the image forming apparatus.

The same JP-2001-222160-A describes that the disposition of a seal member for preventing the toner from scattering is recommended. Specifically, the seal member formed of urethane foam or felt is sandwiched between the intake port shutter and an intake port shutter cover or between the outlet shutter and an outlet shutter support member, for example.

However, the seal member of JP-2001-222160-A does not include a pressing means to press the toner cartridge, and therefore, when the toner cartridge is installed, the toner cartridge may float at a joint portion with the process cartridge due to the seal member disposed for preventing the toner from scattering or due to a resistance from the shutter mechanism. In such a case, when the external cover is closed without the joint portion being appropriately sealed, there occurs a problem that parts or components are damaged or that the toner scatters.

SUMMARY

Therefore, the present invention provides an image forming apparatus capable of preventing damage to each part or component and the toner as a developer from scattering, and includes: a developer container to contain a developer therein and including a developer supply port; an image forming unit to form an image by being replenished with the developer from the developer container and including a developer intake port; an openably closable upper cover configured to cover an upper part of the developer container in a closed state and to take out the developer container in an open state; an openably closable retention cover to hold the developer container and allow the image forming unit to be removed when the retention cover is opened; a coupling device to secure a coupled state of the developer supply port of the developer container with the developer intake port of the image forming unit when the upper cover is in a closed state; and a disconnection preventer to prevent the developer container from disconnecting from the retention cover when the upper cover is opened.

These and other objects, features, and advantages of the present invention will become apparent upon consideration of the following description of the preferred embodiments of the present invention when taken in conjunction with the accompanying drawings.

DETAILED DESCRIPTION

Hereinafter, preferred embodiments of the present invention will now be described with reference to the accompanying drawings.

Figure 1:
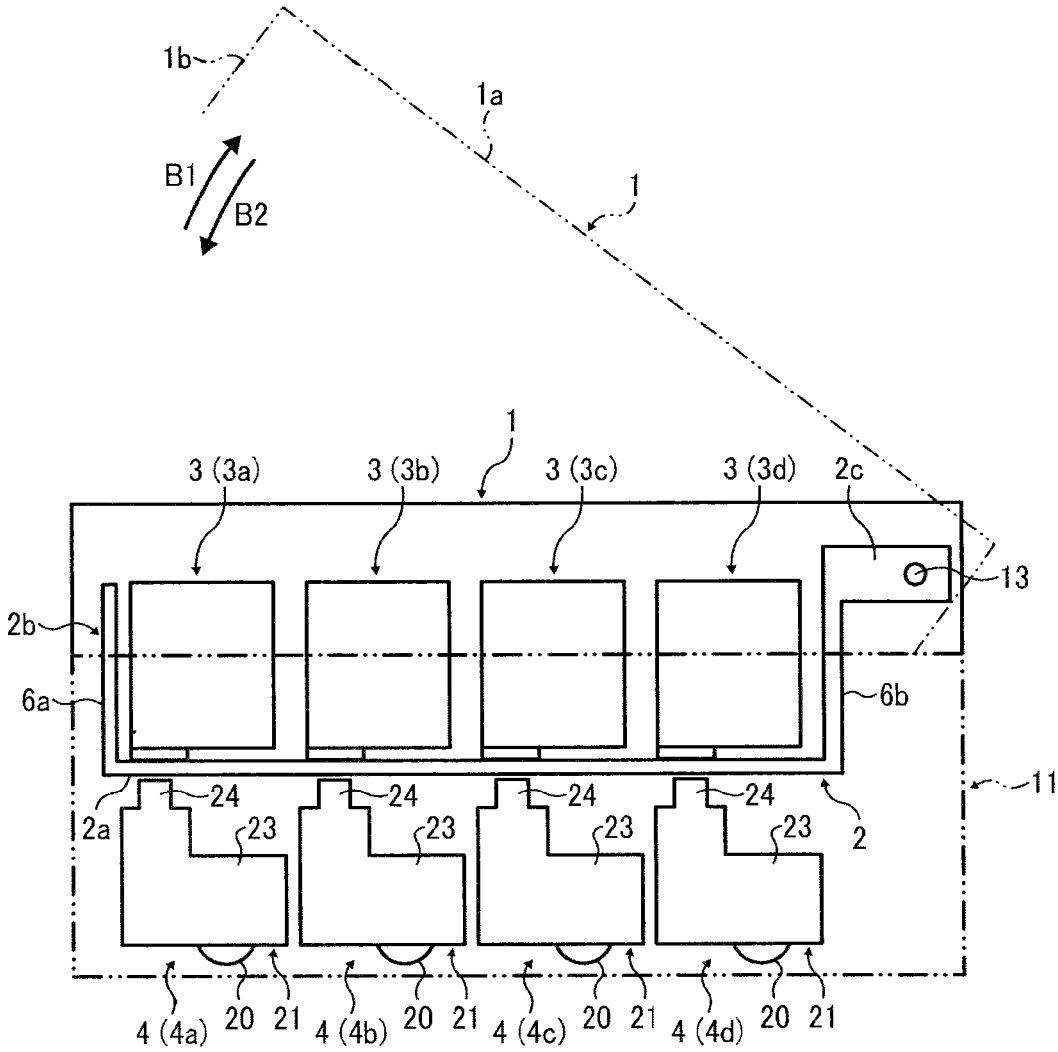
FIG. 1 is an overview diagram of an image forming apparatus according to an embodiment of the present invention.
Figure 13:
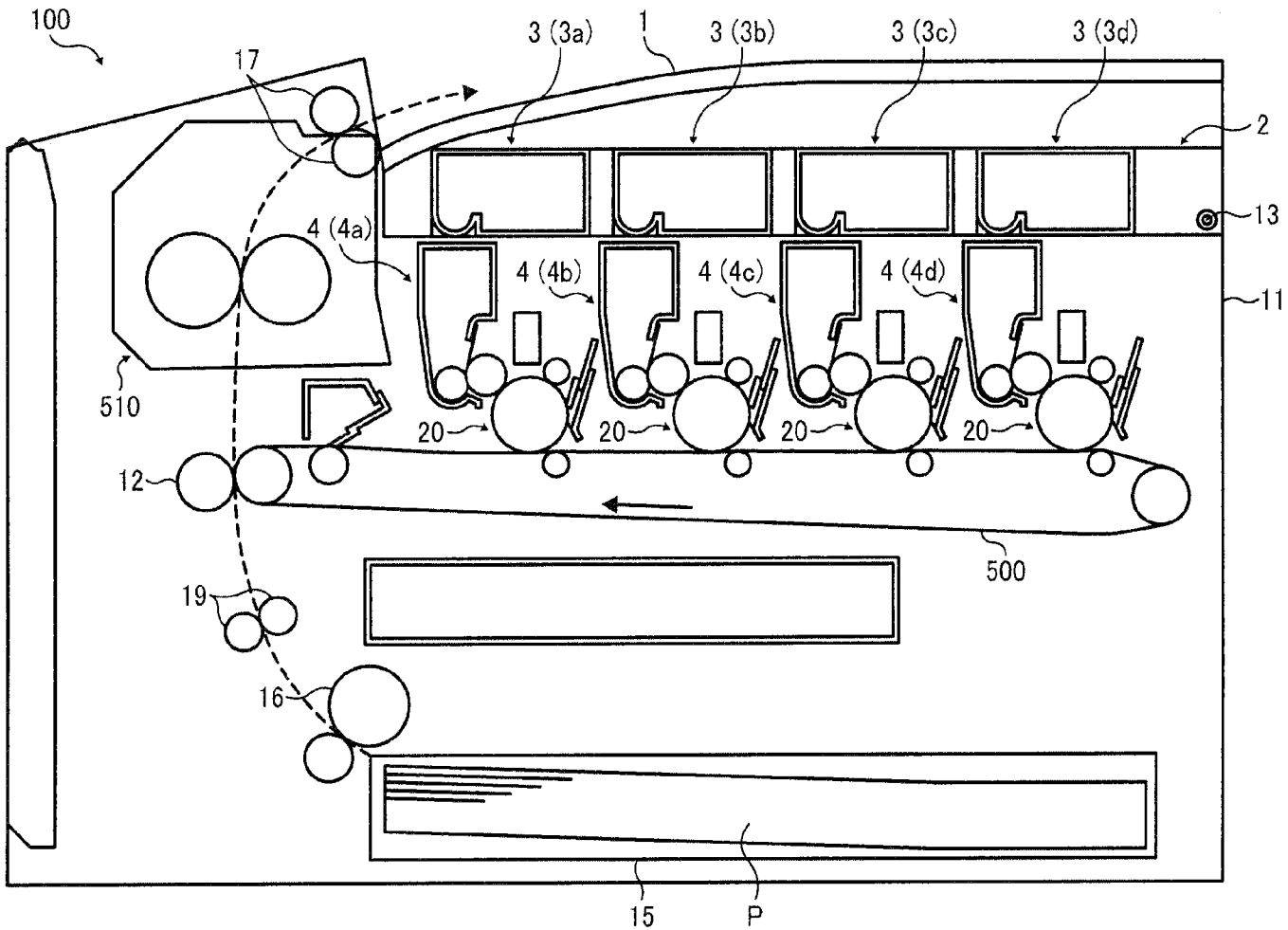
FIG. 13 shows a schematic view of an image forming apparatus according to an embodiment of the present invention.
Figure 14:
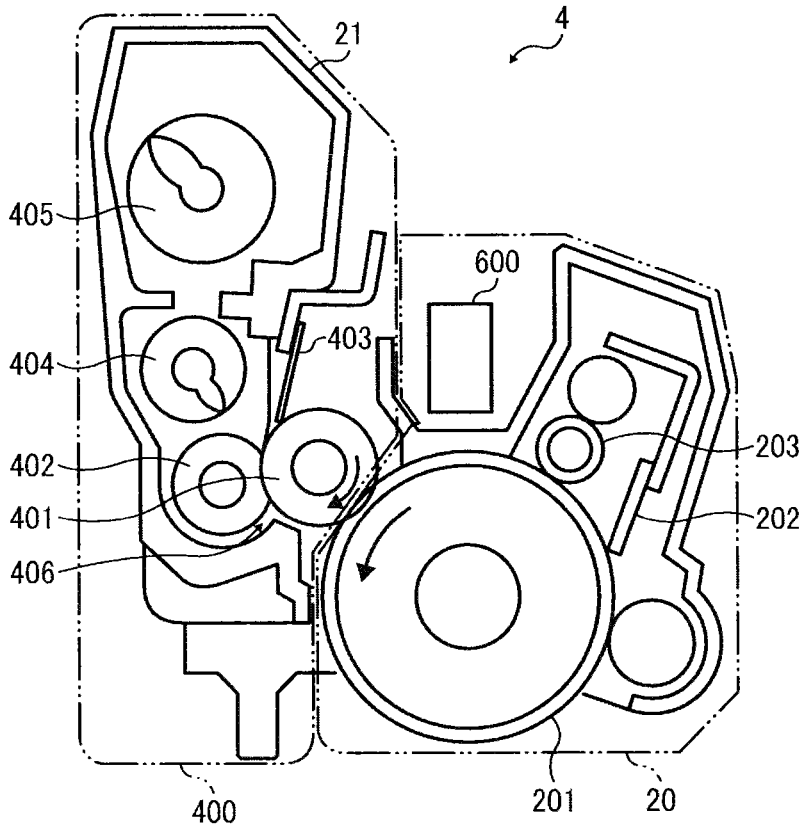
FIG. 14 is a cross-sectional view of an image forming unit of the image forming apparatus.

FIG. 1 is an overview of a color image forming apparatus according to an embodiment of the present invention. FIG. 13 is an overview of a color image forming apparatus 100 according to an embodiment of the present invention and FIG. 14 shows a cross-sectional view of an image forming unit as illustrated in FIG. 13. The image forming apparatus 100 includes four developer containers or toner cartridges 3 (3*a*, 3*b*, 3*c*, and 3*d*), each including toner of a different color, and image forming units or process cartridges 4 (4*a*, 4*b*, 4*c*, and 4*d*). The image forming units each include a photoreceptor drum as an image carrier and a developing device, and serve as a developer receiving cartridge.

The image forming units 4*a*, 4*b*, 4*c*, and 4*d* are disposed at predetermined intervals in the center of the main body 11 of the image forming apparatus 100. Hereinafter, the image forming unit 4*a* is used as a representative and will be described.

Figure 4:
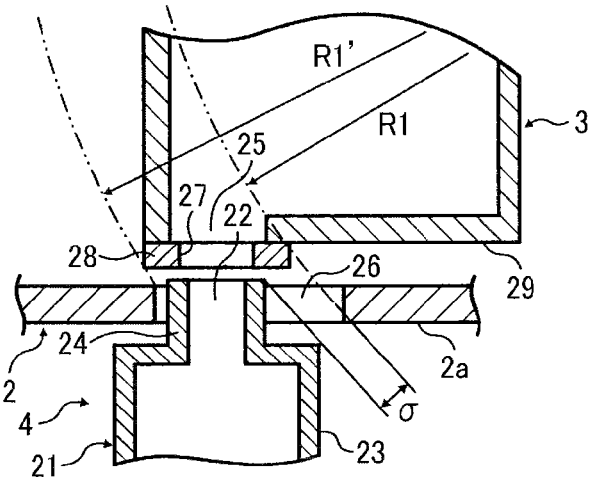
FIG. 4 is an enlarged cross-sectional view illustrating a main part between the developer container and the retention cover of FIG. 3.

The image forming unit 4*a* is disposed in a casing 21 and includes a photoreceptor unit 20 including a photoreceptor drum or simply a photoreceptor 201 and a developing unit 400 including a developer roller 401. As illustrated in FIG. 4, a developer intake port 22 to receive developer from the developer container 3 is formed in the casing 21. The intake port 22 is defined by a protruding portion 24 protruding from a casing body 23 and perforated to take in the developer from the developer container 3. The protruding portion 24 formed on the casing body 23 is disposed at a position away from a support shaft 13 (shown in FIG. 2).

FIG. 14 shows an image forming unit 4 including a developing unit 400. The developing unit 400 includes a developer roller 401 to carry toner thereon; a supply roller 402 to supply toner to the developer roller 401; a regulation blade 403 to regulate a thickness of the toner carried on the developer roller 401; a conveyance screw 404 to convey the toner; and an agitator 405 to stir/agitate the toner. An opening portion 406 is provided at a lower portion of the casing body 23 opposed to the photoreceptor 201. The developer roller 401 is rotatably disposed in the opening portion 406.

The supply roller 402 is contacted to the developer roller 401 and a nip is formed between the both rollers 401 and 402. When an instruction to start image formation is received, the toner inside a developer housing 40 is agitated by the agitator 405 and supplied by the conveyance screw 404 to the supply roller 402. The toner supplied to the supply roller 402 is friction-charged by friction generated between the supply roller 402 and the developer roller 401 at the nip and is supplied to a surface of the developer roller 401. The toner carried on the developer roller 401 passes through the nip of the regulation blade 403, in which a thickness of the toner layer is regulated and is charged by friction. Then, when the toner on the developer roller 401 is conveyed to the developing area where the photoreceptor 201 is opposed to the developing roller 401, toner is transferred to an electrostatic latent image on the photoreceptor 201 by an electric field generated between the photoreceptor 201 and the developer roller 401, whereby the toner image is formed on the photoreceptor 201.

Each photoreceptor unit 20 includes a photoreceptor 201, a charging roller 203 to electrically charge a surface of the photoreceptor 201, a cleaning blade 202 to clean the surface of the photoreceptor 201, and the like. An exposure unit 600 to expose the surface of the photoreceptor 201 is disposed at a position opposed to each photoreceptor 201. The exposure unit 600 irradiates the charged surface of each photoreceptor 201 with laser beams and forms an electrostatic latent image on the surface of each photoreceptor 201. Then, the toner image on the photoreceptor 201 is conveyed by a rotation of the photoreceptor 201 and is transferred onto the intermediate transfer belt 500. Each developing unit 400 develops the electrostatic latent image on the photoreceptor into a toner image, the photoreceptor 201 rotates so that the toner image thereon is conveyed, and the conveyed toner image is superimposed on the toner image on the intermediate transfer belt 500. Specifically, each toner image of a different color is superimposed on the intermediate transfer belt 500 so that a full color toner image is formed thereon.

A sheet-like recording medium P such as a regular sheet or an OHP sheet is supplied from a sheet feed tray 15 at a proper timing, via a sheet feed roller 16 and a registration roller pair 19, to a secondary transfer device or the secondary transfer roller 12. A monochrome or colored toner image is formed on the surface of the intermediate transfer belt 500. By applying a high potential to the secondary transfer device, potential difference is generated between the potential of the intermediate transfer belt 500 and the secondary transfer device. With this potential difference, the toner image formed on the surface of the intermediate transfer belt 500 is transferred onto the recording medium.

The recording medium P onto which the toner image has been transferred is peeled off the intermediate transfer belt 500, a fixing device 510 fuses and fixes the toner image onto the recording medium P, and the recording medium P is then discharged by a sheet discharge roller 17 on an upper cover 1 as a sheet stack tray of the image forming apparatus 100.

Figure 2:
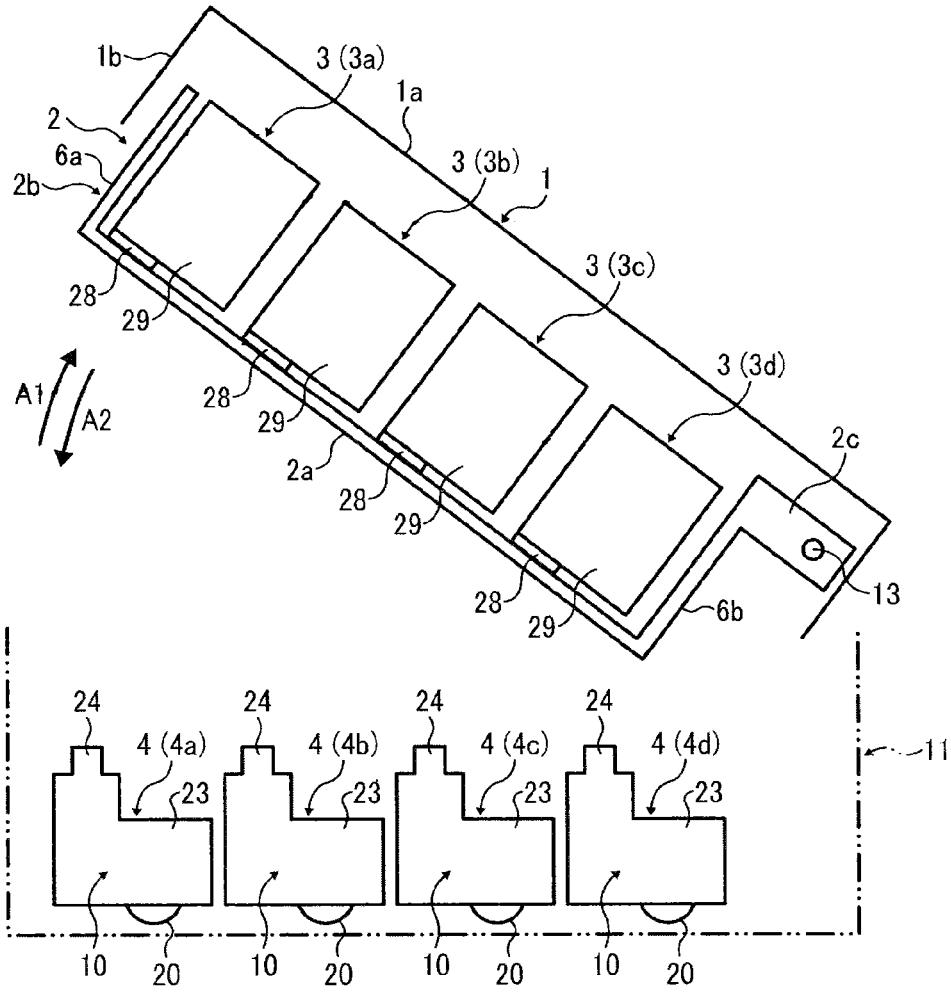
FIG. 2 is an overview diagram of the image forming apparatus in FIG. 1, in a state in which image forming units are removed.

The four developer containers 3 (3*a*, 3*b*, 3*c*, and 3*d*) are held by an openably closable retention cover 2. The retention cover 2 includes a bottom wall 2*a*, a side wall 2*b* which protrudes from an edge of the bottom wall 2*a*, and an outer flange 2*c* which extends from an upper edge of the side wall 2*b* and is disposed at the side of the developer container 3*d*. The outer flange 2*c* is retained by the support shaft 13 which is supported to the image forming apparatus 100. With this structure, the retention cover 2 is rotatable in A1 and A2 directions about the support shaft 13 as illustrated in FIG. 2. The side wall 2*b* includes longer wall portions 6*a* and 6*b* and shorter wall portions 6*c* and 6*d* (shown in FIG. 5).

A state in which the bottom wall 2*a* of the retention cover 2 is horizontal as illustrated in FIG. 1 is called a closed state and another state in which the retention cover 2 is rotated in the arrow A1 direction as illustrated in FIG. 2 so that the image forming unit 4 is removable from the image forming apparatus 100 is called an open state. Further, as illustrated in FIG. 1, a receiver, not shown, to receive the retention cover 2 when the retention cover 2 is closed is disposed at the image forming apparatus 100.

The developer containers 3 are disposed on the retention cover 2 at predetermined intervals. In the closed state of the retention cover 2 as illustrated in FIG. 1, each of the developer containers 3 is disposed opposite a respective one of the image forming units 4*a*, 4*b*, 4*c*, and 4*d*.

Figure 3:
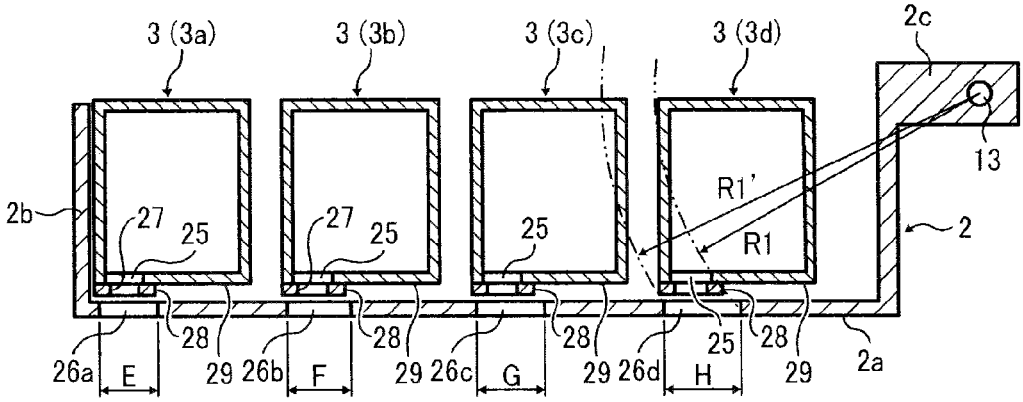
FIG. 3 is a cross-sectional view illustrating developer containers, a retention cover, and a relation therebetween.

As illustrated in FIGS. 3 and 4, a developer supply port 25 is disposed on a bottom wall 29 of the developer container 3, and a through-hole 26 opposed to the developer supply port 25 is disposed in the bottom wall 2*a* of the retention cover 2.

In this case, as illustrated in FIG. 4, the intake port 22 is formed at the protruding portion 24 of the image forming unit 4 so that the protruding portion 24 may protrude into the through-hole 26. In addition, a seal member 28 including a through-hole 27 is disposed between the developer supply port 25 and the through-hole 26. The seal member 28 is formed of materials such as foamed urethane and felt, and is attached to the bottom wall 29 of the developer container 3.

The through-hole 26 in the bottom wall 2*a* of the retention cover 2 is dimensioned so that a clearance 6 is formed when the protruding portion 24 is inserted into the through-hole 26 as illustrated in FIG. 4.

Because the retention cover 2 rotates about the support shaft 13 in the arrow A1 or A2 direction, the through-hole 26 has an open width sequentially narrowing from the through-hole 26 nearest the support shaft 13 to the through-hole 26 farthest from the through-hole 26 (26*a*, 26*b*, 26*c*, and 26*d*). Specifically, as illustrated in FIG. 3, when the open width of the through-hole 26*a* of the developer container 3*a* is set as E, the open width of the through-hole 26*b* of the developer container 3*b* is set as F, the open width of the through-hole 26*c* of the developer container 3*c* is set as G, and the open width of the through-hole 26*d* of the developer container 3*d* is set as H, an inequality E<F<G<H stands.

As described in FIGS. 3 and 4, when a radius from the support shaft 13 to an internal opening edge of the developer supply port 25 of the side of the support shaft 13 is set as R1, an external opening edge of the through-hole 26 of the side of the support shaft 13 positions on the locus of the radius R1, and when a radius from the support shaft 13 to the edge of the seal member 28 at a side opposite the support shaft 13 is set to R1', an internal opening edge of the through-hole 26 at the side opposite the support shaft 13 positions on the locus of the radius R1 Then, the open width of the through-hole 26 is gradually narrowed from the one nearest the support shaft 13 to the one farthest from the support shaft 13.

Figure 5:
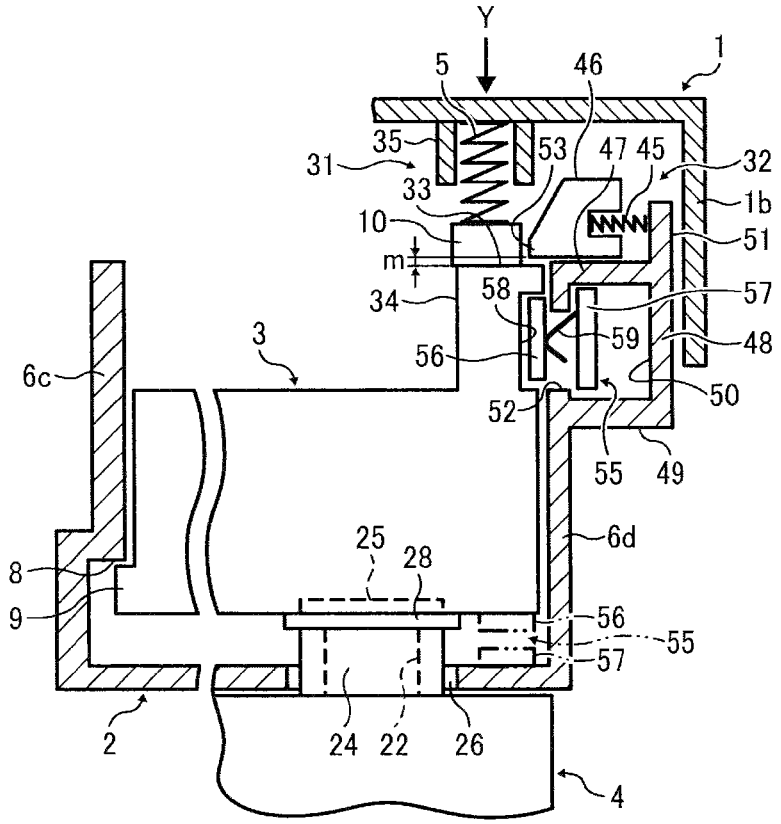
FIG. 5 is a cross-sectional view illustrating a coupling device and a disconnection preventer.

FIG. 5 is a cross-sectional view of FIG. 1, seen from one side. The developer containers 3 are positioned in parallel toward backside in the figure. A stepped portion 8 is formed on the shorter wall portion 6*c* of the side wall 2*b* of the retention cover 2 and a projection 9 configured to engage with the stepped portion 8 is disposed on the developer container 3. The projection 9 is disposed so that the developer supply port 25 is positioned between the projection 9 and a top end surface 33.

Further, as illustrated in FIGS. 1 and 2, the openably closable upper cover 1 covering the top of the developer container 3 in a closed state is disposed at the top of image forming apparatus 100. The upper cover 1 includes an upper wall 1*a* and a circumferential wall 1*b* which extends downward from the edge of the upper wall 1*a*, and is supported by the support shaft 13. With this structure, the upper cover 1 rotates about the support shaft 13 in the arrow directions A1 and A2. A solid line in FIG. 1 shows a state in which the upper opening of the image forming apparatus 100 is covered, i.e., the closed state. In the closed state, the developer container 3 held on the retention cover 2 is covered. Further, when the upper cover 1 is closed, a bottom end of the circumferential wall 1*b* is positioned below the upper end of the side wall 2*b*. When the upper cover 1 is rotated in an arrow B1 direction as illustrated in a broken line from a state as illustrated by a solid line, the developer container 3 held by the retention cover 2 is removed from the image forming apparatus 100. The upper cover 1 may have the wall 1*a* in common with the sheet stack tray 1 as illustrated in FIG. 13 or as a separate part.

The upper cover 1 includes a coupling device as illustrated in FIG. 5. In the present embodiment, the coupling device is a first biasing means 31, which maintains communication between the developer supply port 25 of the developer container 3 and the developer intake port 22 of the image forming unit 4. The first biasing means 31 includes a spring 5 such as a coil spring and a pressing member 10 to press the top end surface 33 of a protruding member 34 protruding upward from a top surface of an opposite side of the developer container 3. The first biasing means 31 may be disposed at each developer container 3 disposed in parallel distally in FIG. 5. Alternatively, it may be configured such that only one first biasing means 31 presses plural developer containers 3.

Specifically, a cylindrical well 35 is configured to extend from the upper wall 1*a* of the upper cover 1 and the spring 5 is held by the well 35. Further, the pressing member 10 attached to the spring 5 is disposed on the top end surface 33 of the developer container 3. As illustrated in FIG. 5, when the upper cover 1 is closed, the pressing member 10 presses against the top end surface 33 of the developer container 3 due to the elastic force of the spring 5 exerted in an arrow Y direction. With this structure, an edge face of the protruding portion 24 of the image forming unit 4 is pressed against the seal member 28 of the developer container 3, thereby retaining a coupling status between the developer supply port 25 of the developer container 3 and the developer intake port 22 of the image forming unit 4.

Figure 6:
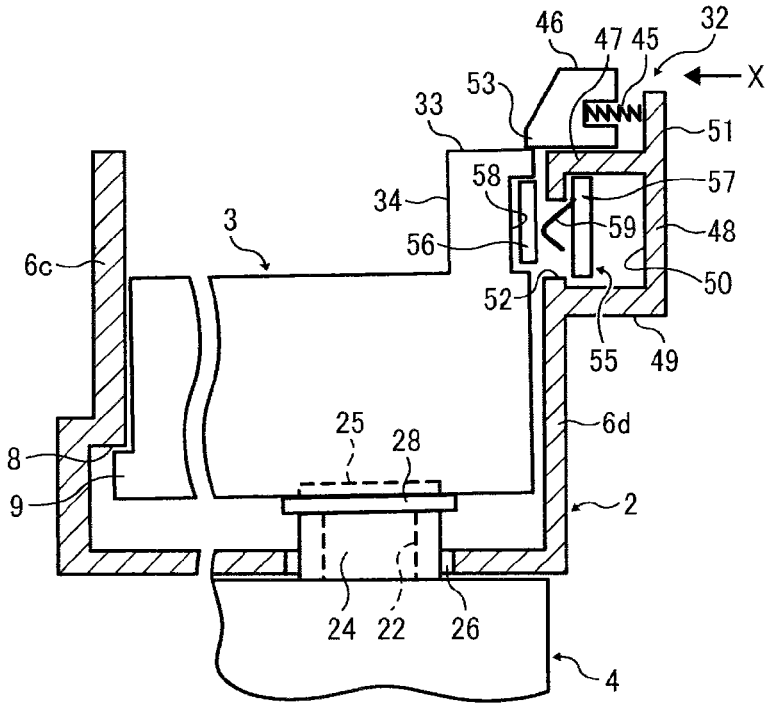
FIG. 6 is a cross-sectional view illustrating a relation between the disconnection preventer as a regulating member and the developer container.

Further, as illustrated in FIGS. 5 and 6, a disconnection preventer or a regulating member is disposed on the retention cover 2. In the present embodiment, the disconnection preventer is a second biasing means 32. The second biasing means 32 prevents the developer container 3 from disconnecting from the retention cover 2. The second biasing means 32 includes a spring 45 such as a coil spring and a pressing member 46 to press the top end surface 33 of the developer container 3. The second biasing means 32 may be provided for each of the developer containers 3 disposed in parallel distally in FIG. 5. Alternatively, only one second biasing means 32 may be disposed to prevent disconnection of the plural developer container 3.

Specifically, a chamber 50 formed of an upper wall 47, a side wall 48, and a bottom wall 49 is disposed on the shorter wall portion 6*d* of the retention cover 2. A reception wall 51 which is higher than the upper wall 47 is disposed on the side wall 48. In addition, this hollow chamber 50 includes a window 52, which is open at an opposite side of the side wall 48. Then, the pressing member 46 is placed on the upper wall 47 and the spring 45 is disposed between the pressing member 46 and the reception wall 51.

The pressing member 46 is pressed in an arrow X direction by the spring 45. In general, a leading edge 53 of the pressing member 46 protrudes toward the opposite side of the reception wall 51 than the upper wall 47 so that a part of the top end surface 33 of the image forming unit 4 is covered by the pressing member 46. A projection amount of the leading edge 53 is preferably in such a range that the developer container 3 is prevented from going up when the upper cover 1 is opened.

In a state in which the image forming unit 4 is pressed downwards by the first biasing means 31, the pressing member 46 of the second biasing means 32 is positioned slightly higher than the top end surface 33 of the developer container 3 by a predetermined length m as illustrated in FIG. 5.

Accordingly, when the upper cover 1 is opened, downward pressing of the first biasing means 31 against the image forming unit 4 is released. In this state, the image forming unit 4 exerts a pushing up force and the developer container 3 is elevated as illustrated in FIG. 6. The projection 9 on the left side of the developer container 3 contacts the stepped portion 8 so that the developer container 3 does not get elevated further. With this structure, the developer container 3 is inclined with its right side uplifted, but because the pressing member 46 is disposed within a moving range of the right edge of the top end surface 33, the rise of the developer container 3 is prevented by the pressing member 46 of the second biasing means 32.

The present image forming apparatus includes a reading means 55 to read information relating to the developer inside the developer container 3. The information relating to the developer includes a color of the developer or an amount of the developer.

The reading means 55 includes a recording medium 56 to store the information related to the developer and a reading medium 57 to read the information in the recording medium 56. The recording medium 56 is included in a concave portion 58 on the side wall of the protruding member 34 of the developer container 3. The reading medium 57 is installed in the hollow chamber 50 of the retention cover 2. With this structure, the recording medium 56 and the reading medium 57 are horizontally opposed each other via the window 52.

In the present embodiment, the recording medium 56 is implemented as an IC chip and disposed directly below the top end surface 33. Further, as illustrated in FIG. 5, preferably the leading edge 53 of the pressing member 46 is positioned above the recording medium 56. The reading medium 57 reads information relating to the IC chip and is disposed below the pressing member 46. As illustrated in FIG. 5, when the upper cover 1 is in the closed state, the recording medium 56 and the reading medium 57 electrically connect to each other via a connection terminal 59 so that the data in the recording medium 56 is read by the reading medium 57. Further, as illustrated in FIG. 6, when the upper cover 1 is in the open state, the developer container 3 inclines with its right side upward so that the electrical connection between the recording medium 56 and the reading medium 57 is broken.

As a reading means 55, when the upper cover 1 is in the closed state, the recording medium 56 and the reading medium 57 are horizontally opposed to each other in the above embodiment. However, as shown by a hypothetical line in the bottom of FIG. 5, the recording medium 56 and the reading medium 57 may be vertically opposed to each other.

According to the image forming apparatus as described above, when the upper cover 1 is closed, the upper portion of the developer container 3 can be covered, and when the upper cover 1 is open, the developer container 3 can be pulled out and the developer container 3 can be replaced with a new one. In addition, when the retention cover 2 is open, the image forming unit 4 can be taken out. Accordingly, maintenance of the image forming apparatus and the replenishment of the developer may be performed easily and speedily.

The first biasing means 31 secures a coupled status of the developer supply port 25 of the developer container 3 with the developer intake port 22 of the image forming unit 4 so that the developer may be supplied stably from the developer container 3 to the image forming unit 4, thereby preventing the leakage of the developer.

The second biasing means 32 prevents the developer container 3 from disconnecting from the retention cover 2. Accordingly, in the opening and closing of the retention cover 2, the developer container 3 can be prevented from disconnecting from the retention cover 2 and the operation can be performed smoothly. Further, the damage to the developer container 3 and the leakage of the developer from the developer container 3 toward an outside can be effectively prevented. In addition, because the positional shift of the supply port 25 of the developer container 3 can be prevented, the leakage of the developer inside the image forming apparatus may be effectively prevented.

The retention cover 2 holds a plurality of developer containers 3 disposed in parallel and rotates the plurality of developer containers 3 about the support shaft 13 located at an edge of the parallelly-disposed direction of the developer containers 3. Thus, by rotating the hinged retention cover 2 about the support shaft 13, the opening and closing can be easily performed. Because the open width of the through-hole 26 of the retention cover 2 is sequentially narrowed from the through-hole 26 nearest to the support shaft 13 as it comes to farther away from the support shaft 13, the open width of the through-hole 26 can be optimized for each through-hole 26 and the retention cover 2 can be prevented from weakening.

The reading means 55 enables a user to recognize misplacement of the developer container 3 and a remaining amount of the developer and a stable image formation becomes possible.

Because the reading means 55 is composed of the recording medium 56 and the reading medium 57, a compact image forming apparatus can be realized. Even though the recording medium 56 and the reading medium 57 are horizontally disposed opposed to each other or vertically disposed opposed to each other, the same effect can be obtained, thereby making the design of the image forming apparatus more flexible.

Figure 7:
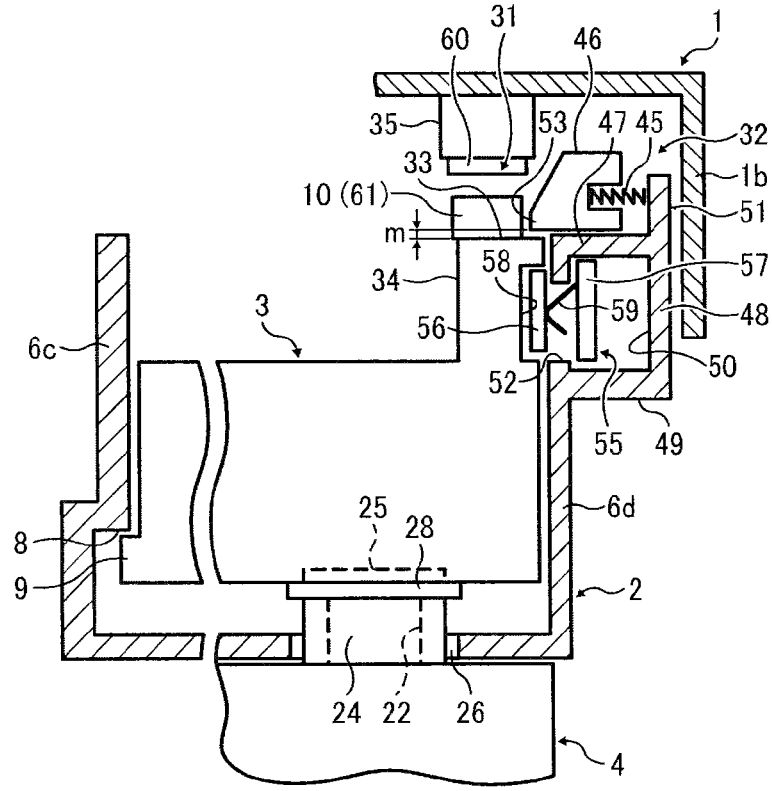
FIG. 7 shows a cross-sectional view illustrating a modified example of the coupling device.
Figure 8:
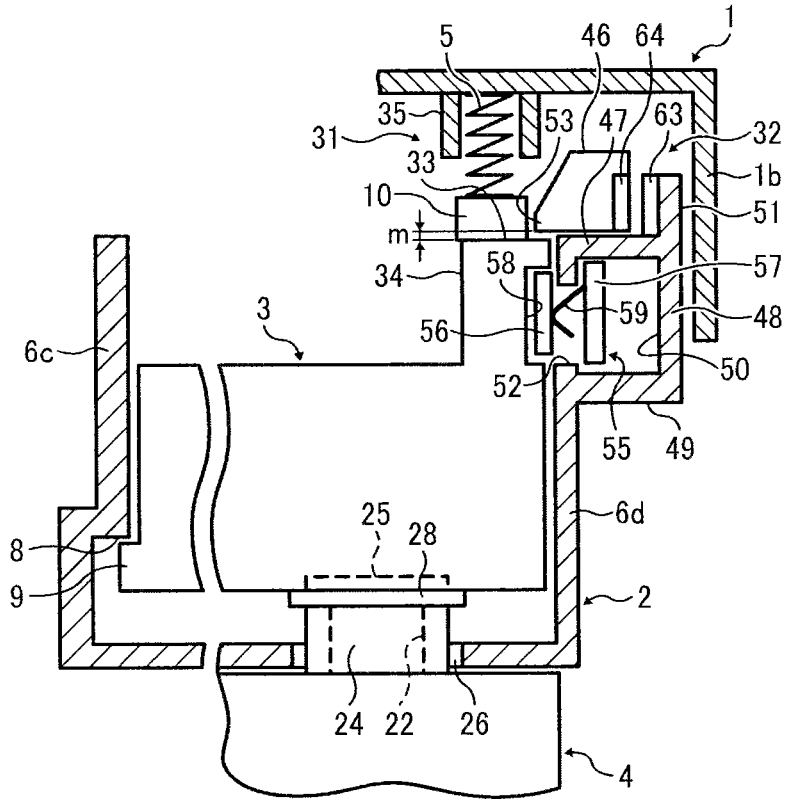
FIG. 8 shows a cross-sectional view illustrating a modified example of the disconnection preventer.

The first and second biasing means 31 and 32 employ springs 5 and 45, respectively, in the above embodiment. The biasing means may also employ a magnetic force as illustrated in FIGS. 7 and 8. Specifically, as illustrated in FIG. 7, the first biasing means 31 may employ a magnet 60 instead of the spring 5 and the pressing member 10 wholly or a part thereof opposed to the magnet 60 is made a magnet 61. In this case, the magnetic pole of the magnet 60 opposed to the pressing member 10 and that of the pressing member 10 opposed to the magnet 60 are made identical. With this structure, the magnet 60 and the magnet 61 of the pressing member 10 act repulsively so that the developer container 3 is pressed against the image forming unit 4 similar to the case of using the spring 5.

FIG. 8 shows a case in which the second biasing means 32 employs a magnet 63 instead of the spring 45 and the magnet 63 is attached to the reception wall 51 of the retention cover 2. Then, a magnet 64 is attached to the pressing member 46 so that the magnet 64 is opposed to the magnet 63. In this case, the magnetic pole of the magnet 63 opposed to the pressing member 46 and that of the magnet 64 opposed to the reception wall 51 are made identical. With this structure, the magnet 63 and the magnet 64 act repulsively so that the pressing member 46 can be pressed to the reverse direction to the reception wall 51 similar to the case of using the spring 45.

The first and second biasing means 31 and 32 are constructed with a spring or a magnet, thereby simplifying the apparatus and lowering the manufacturing cost. In particular, use of the magnet may achieve space saving in the apparatus as a whole.

Figure 10:
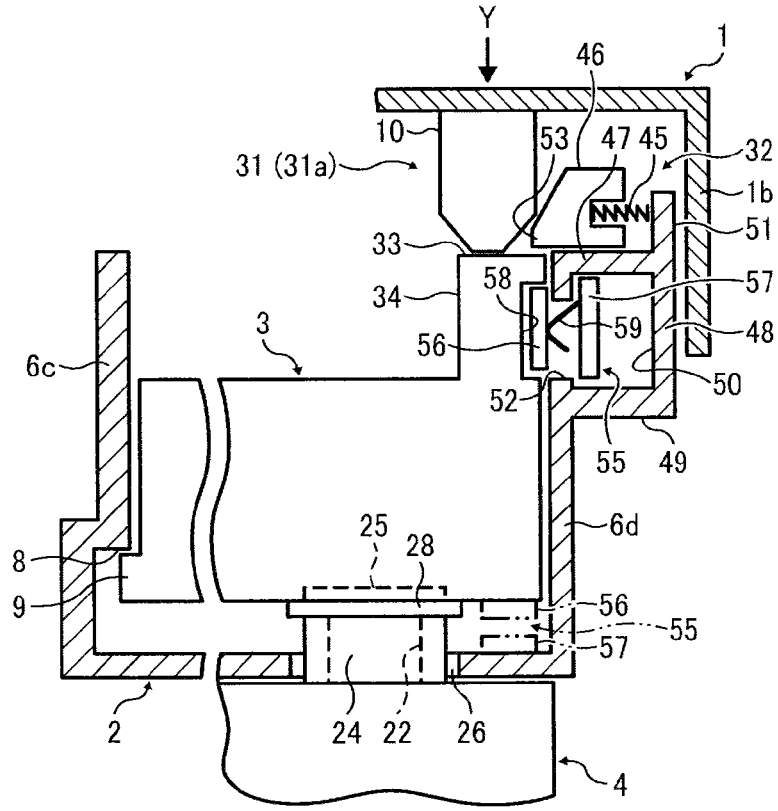
FIG. 10 is a cross-sectional view illustrating a modified example of the coupling device.
Figure 11:
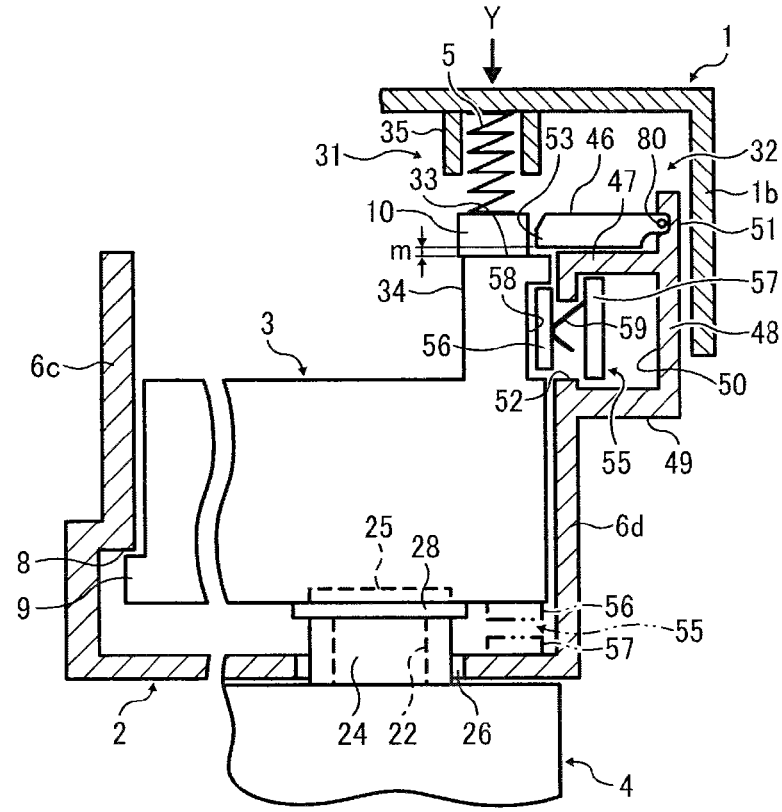
FIG. 11 shows a cross-sectional view illustrating a modified example of the disconnection preventer.
Figure 12:
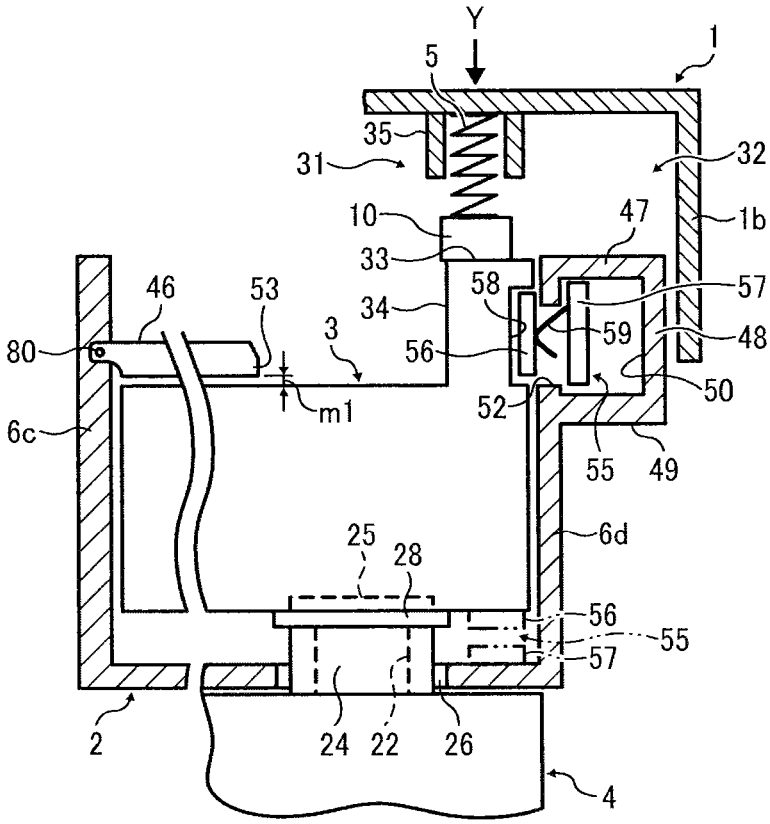
FIG. 12 is a cross-sectional view illustrating another modified example of the disconnection preventer.

In the above embodiment, the first and second biasing means 31 and 32 are used as a coupling device and a disconnection preventer or a regulating member, but any fixed members may be used as illustrated in FIGS. 10 to 12.

FIG. 10 shows an example using a convex portion 31*a* instead of the first biasing means 31 formed of the spring 5 and the pressing member 10. The convex portion 31*a* extends downwards from the upper cover 1. When the upper cover 1 is closed, a lower surface of the convex portion 31*a* presses the top end surface 33, whereby the developer container 3 is pressed against the image forming unit 4 similar to the case of using the spring 5.

FIG. 11 shows an example using a regulating member 46 disposed on the reception wall 51 instead of the second biasing means 32 formed of the spring 45 and the pressing member 46. The regulating member 46 is attached to the reception wall 51 to rotate about a rotary shaft 80. Further, in the state of FIG. 11, the regulating member 46 is prevented from rotating by a lock mechanism, not shown. Even in the state in which the upper cover 1 is open, the developer container 3 is prevented from moving up by the regulating member 46 which is prohibited to rotate.

FIG. 12 shows an example using a regulating member 46 disposed on the shorter wall portion 6*c* instead of the second biasing means 32 formed of the spring 45 and the pressing member 46 and the projection 9 engaging with the stepped portion 8. The regulating member 46 is attached to the shorter wall portion 6*c* to rotate about a rotary shaft 80. Further, in the state of FIG. 12, the regulating member 46 is prevented from rotating by a lock mechanism, not shown. Because there is no projection 9 engageable with the stepped portion 8 when the upper cover 1 is open, the developer container 3 moves as a whole, but the developer container 3 is prevented from moving up due to the regulating member 46 which is prohibited to rotate. Further, similar to the description referring to FIG. 6, when the upper cover 1 is in the open state, the length and interval m1 (in mm) of the regulating member 46 is set such that the electrical connection between the recording medium 56 and the reading medium 57 is released. In addition, as long as the regulating member 46 can be evacuated when the developer container 3 is taken out, the second biasing means 32 composed of the spring 45 and the pressing member 46 may be disposed at the mounting position of the regulating member 46 instead of the regulating member 46 as illustrated in FIG. 12.

Figure 9:
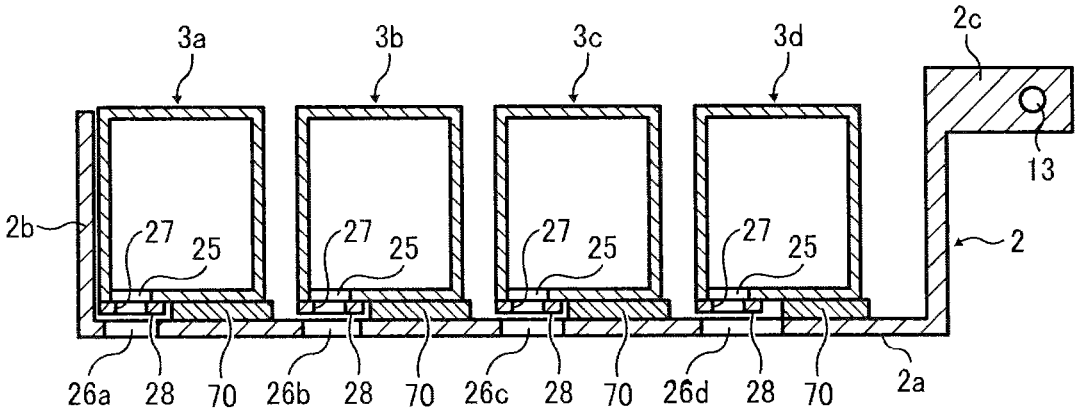
FIG. 9 is a cross-sectional view of a main part of the image forming apparatus according to another embodiment of the present invention.

FIG. 9 shows that an antivibration member 70 is disposed between the developer container 3 and the retention cover 2. The antivibration member 70 is formed of a rubber or polyurethane resins and has a planar body, and is disposed between the bottom surface of the developer container 3 and an interior wall of the bottom wall 2*a* of the retention cover 2. In this case, the antivibration member 70 is attached to either the bottom surface of the developer container 3 or the interior wall of the bottom wall 2*a* of the retention cover 2.

When the antivibration member 70 is disposed, vibration between the developer container 3 and the image forming unit 4 can be decreased so that the scattering of the developer during printing operation can be prevented and sound noise of the whole image forming apparatus is lessened.

The image forming apparatus to which the present invention may be applied also includes an electrophotographic copier, a laser beam printer, and a facsimile apparatus.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

a developer container to contain a developer therein and including a developer supply port;

an image forming unit to form an image with the developer from the developer container and including a developer intake port;

an openably closable upper cover configured to cover an upper part of the developer container in a closed state and to allow the developer container to be removed from the image forming apparatus in an open state;

an openably closable retention cover to hold the developer container and configured to allow the image forming unit to be removed from the image forming apparatus when the retention cover is opened;

a coupling device to secure a coupled state of the developer supply port of the developer container with the developer intake port of the image forming unit when the upper cover is in a closed state; and a disconnection preventer to prevent the developer container from disconnecting from the retention cover when the upper cover is opened.

2. An image forming apparatus as claimed in claim 1, wherein the coupling device is a first biasing means attached to the upper cover and presses the developer container against the image forming unit.

3. An image forming apparatus as claimed in claim 1, wherein the disconnection preventer is a second biasing means attached to the retention cover and preventing the developer container held by the retention cover from disconnecting from the retention cover when the upper cover is open.

4. An image forming apparatus as claimed in claim 3, further comprising:

a stepped portion formed on the retention cover; and a projection formed on the developer container, wherein the stepped portion engages the projection of the developer container to prevent disconnection of the developer container and is positioned at an opposite side of the second biasing means with respect to the developer container.

5. An image forming apparatus as claimed in claim 1, wherein:

a plurality of developer containers are disposed in parallel on the retention cover;

the retention cover includes through-holes, through which the developer intake port of each of the image forming units is inserted corresponding to each developer supply port of the developer containers along the parallelly-disposed direction of the developer containers; and the retention cover rotates about a support shaft disposed at one end thereof in the parallelly-disposed direction of the developer containers.

6. An image forming apparatus as claimed in claim 5, further comprising a seal member including a through-hole, wherein, when a radius from the support shaft to an internal opening edge of the developer supply port of the side of the support shaft is set as R1, an external opening edge of the through-hole of the side of the support shaft is positioned on the locus of the radius R1, and a radius from the support shaft to the edge of the seal member at a side opposite the support shaft is set to R1', an internal opening edge of the through-hole at the side opposite the support shaft is positioned on the locus of the radius R1'.

7. An image forming apparatus as claimed in claim 5, wherein the open widths of the through-holes are sequentially narrowed from the through-hole nearest the support shaft to the through-hole farthest from the support shaft.

8. An image forming apparatus as claimed in claim 4, wherein the developer container further comprises another projection disposed to position the developer supply port between the another projection and a top end surface of the developer container.

9. An image forming apparatus as claimed in claim 1, wherein the upper cover is a sheet stack tray for stacking a recording medium thereon after image formation.

10. An image forming apparatus as claimed in claim 3, wherein the second biasing means comprises a spring and a pressing member to press the top end surface of the developer container, wherein the pressing member of the second biasing means is positioned slightly higher than the top end surface of the developer container by a predetermined length.

11. An image forming apparatus as claimed in claim 1, further comprising a convex portion extending downwards from the upper cover and serving as the coupling device such that a lower surface of the convex portion presses the top end surface of the developer container so that the developer container is pressed against the image forming unit.

12. An image forming apparatus as claimed in claim 1, wherein the disconnection preventer is a rotatable pressing member attached to the retention cover, engaging the developer container held by the retention cover, and rotating about a rotary shaft.

13. An image forming apparatus as claimed in claim 1, further comprising a reading device to read data relating to the developer contained in the developer container.

14. An image forming apparatus as claimed in claim 13, wherein the reading device further comprises a recording medium to store the data related to the developer and a reading medium to read the data in the recording medium, the recording medium is disposed at the developer container side and the reading medium is disposed at the retention cover side, and the recording medium and the reading medium are horizontally opposite each other when the retention cover to hold the developer container is in a closed state.

15. An image forming apparatus as claimed in claim 14, wherein the reading medium is disposed directly below the top end surface of the developer container and a leading edge of a pressing member serving as a regulating member is positioned above the recording medium.

16. An image forming apparatus as claimed in claim 13, wherein the reading device further comprises a recording medium to store the data related to the developer and a reading medium to read the data in the recording medium, the recording medium is disposed at the developer container side and the reading medium is disposed at the retention cover side, and the recording medium and the reading medium are vertically opposite each other when the retention cover to hold the developer container is in a closed state.

17. An image forming apparatus as claimed in claim 1, further comprising an antivibration member disposed between the developer container and the retention cover, wherein the antivibration member is attached to one of the developer container and the retention cover.

18. An image forming apparatus comprising:

a developer container to contain a developer therein and including a developer supply port;

an image forming unit to form an image with the developer from the developer container and including a developer intake port;

means for covering an upper part of the developer container in a closed state and allowing the developer container to be removed from the image forming apparatus in an open state;

means for holding the developer container and allowing the image forming unit to be removed from the image forming apparatus when the means for holding the developer container is opened;

means for securing a coupled state of the developer supply port of the developer container with the developer intake port of the image forming unit when the means for covering the upper part of the developer container is in a closed state; and means for preventing the developer container from disconnecting from the means for holding the developer container when the means for covering the upper part of the developer is opened.

* * * * *